US006194115B1

(12) United States Patent
Nagase et al.

(10) Patent No.: US 6,194,115 B1
(45) Date of Patent: Feb. 27, 2001

(54) TONER COMPOSITION FOR DEVELOPING ELECTROSTATIC LATENT IMAGE

(75) Inventors: Kimikazu Nagase; Masaaki Ishiyama; Takashi Taira; Hiroyuki Takahata; Kousuke Yotsuduka; Shigehiro Hano; Yoshihiro Chujo, all of Shiga (JP)

(73) Assignee: Toray Industries, Inc., Tokoyo (JP)

( * ) Notice: Subject to any disclaimer, the term of this patent is extended or adjusted under 35 U.S.C. 154(b) by 0 days.

(21) Appl. No.: 09/369,481

(22) Filed: Aug. 5, 1999

Related U.S. Application Data

(63) Continuation-in-part of application No. 09/170,343, filed on Oct. 13, 1998, now abandoned.

(30) Foreign Application Priority Data

Feb. 12, 1997 (JP) ..... 9-28067

(51) Int. Cl.[7] ..... G03G 9/097; G03G 13/20
(52) U.S. Cl. ..... 430/110; 430/111; 430/124
(58) Field of Search ..... 430/110, 111, 430/124

(56) References Cited

U.S. PATENT DOCUMENTS

| | | | | |
|---|---|---|---|---|
| 4,594,302 | * | 6/1986 | Kubo | 430/42 |
| 5,266,258 | * | 11/1993 | Matsubayashi et al. | 430/106.6 |
| 5,370,958 | * | 12/1994 | Shin et al. | 430/110 |
| 5,783,347 | * | 7/1998 | Ikami | 430/110 |
| 5,805,966 | * | 9/1998 | Yamada | 399/284 |

FOREIGN PATENT DOCUMENTS

| | | | |
|---|---|---|---|
| 7-110596 | * | 4/1995 | (JP) . |
| 7-191492 | * | 7/1995 | (JP) . |

* cited by examiner

*Primary Examiner*—Roland Martin
(74) *Attorney, Agent, or Firm*—Morrison & Foerster LLP

(57) ABSTRACT

The invention in this application relates to a toner composition for electrostatic latent image development which is characterized in that, in a toner composition comprising at least binder resin, colorant and charge control agent, to be used in a print forming method provided with a print fixing device which fixes the toner image on a recording medium by means of a light flash, the concentration of benzene generated by heating for 90 seconds at 330° C. is no more than 60 $\mu$g/g, and the invention provides a toner composition for electrostatic latent image development which either extends the filter life or does not require the use of a filter.

8 Claims, 4 Drawing Sheets

TONER COMPOSITION FOR DEVELOPING ELECTROSTATIC LATENT IMAGE

This application is a continuation-in-part application of U.S. Ser. No. 09/170,343, filed Oct. 13, 1998, now abandoned.

TECHNICAL FIELD

The present invention relates to a developer powder (hereinafter referred to as a toner composition) for developing an electrostatic latent image in electro-photography, in particular to a toner composition for electrostatic latent image development which is suitable for a laser beam printer or LED printer where flash fixing is carried out on the material being printed at high speed.

TECHNICAL BACKGROUND

The electrophotographic method comprises a charging stage in which a uniform electrostatic charge is conferred on a photosensitive body employing a photoconductive material, an imaging stage in which there is irradiation of light and the formation of an electrostatic latent image, a developing stage in which toner is electrostatically affixed to the area of the latent image, a transfer stage for transferral to a toner image support, a fixing stage in which said toner image is fixed to the toner image support by pressure, heat or flash of light, etc., a cleaning stage in which untransferred toner remaining on the photosensitive body is removed and a discharging stage in which the electrostatic charge on the photosensitive body is eliminated and it is returned to its initial state, and prints are obtained by repetition of these stages.

Cold pressure fixing, which is one of the fixing methods used in an electrophotographic printer, has the advantages that immediate operation is possible, power consumption is low since it does not use a heater as a heat source and there is no danger of burning in the fixing region, but it has disadvantages such as the print fixing properties being inferior and a conspicuous print lustre and low quality, so in general the use of heat fixing systems is more advantageous. As such heat fixing systems, there are known contact heat fixing systems based on hot roll fixing and non-contact heat fixing systems based on fixing by a flash of light or oven fixing by passage through the heated atmosphere of an electric heater.

The present invention relates to fixing by means of a light flash which is a typical non-contact heat fixing system, and the flash fixing system is a method in which the toner visible image is exposed to the emission spectrum of, for example, a xenon lamp or halogen lamp for a short time of no more than milliseconds, so that the toner is softened and fused by the radiant heat thereof and fixed to the toner support (Japanese Unexamined Patent Publication No. 7-107805), and it has the following advantages.

(1) Since it is non-contact fixing, there is no deterioration in the print resolution at the time of development.

(2) There is no waiting time after switching on the power source and a 'quick start' is possible.

(3) Even where recording paper or the like is jammed inside the fixer due to system failure, burning does not occur.

(4) Good fixing properties are shown irrespective of the type of toner support (quality of the recording paper, tack paper, thick paper, etc.)

(5) Since only the toner, which comprises areas of black, is heated, there is little heat shrinkage of the recording paper or the like, the paper feeding properties are excellent and high speed printing is possible.

However, since the flash fixing system comprises non-contact heat fixing, the level of energy dissipation to the surroundings is high and, because it is flash light energy, the thermal efficiency is poor compared to hot roll fixing. In other words, it is fixing system with a high power consumption. Furthermore, with the flash fixing system there has been the problem of decomposed materials, in that the surface temperature of the toner composition instantly reaches a high temperature of several hundred degrees due to the irradiation of a sudden high energy flash of light in an extremely short time, and some of the additives in the toner composition are decomposed and gasify, releasing an unpleasant smell or generating toxic gases.

Generally speaking, with a flash fixing system printer, in order to remove the decomposed materials at the time of the flash fixing, in the flash fixing region there is adopted a method whereby these decomposition products are drawn in, passed through a filter of active carbon or the like, and the toxic gases adsorbed and collected. However, there has been the problem of increased running costs since a filter is used and since the replacement life of this filter is shortened.

The present invention has been made to resolve the aforesaid problems, and it provides a toner composition for electrostatic latent image development where, by suppressing the generation of decomposition products in a printer employing a flash fixing system, a filter is made unnecessary or the problem of increased running costs because of the shortening of the filter replacement life is resolved.

DISCLOSURE OF THE INVENTION

The present invention relates to a toner composition fixing method which is characterized in that, when flash fixing a toner composition comprising at least binder resin, colorant and charge control agent, there is used a charge control agent selected from the group comprising quaternary ammonium salt compounds, triphenylmethane type compounds and nigrosine type compounds which have been vacuum heat treated at a temperature of at least 100° C. but no more than 250° C. and at a degree of vacuum of 0.02 MPa or lower.

Furthermore, the present invention relates to a toner composition for electrostatic latent image development used in flash fixing which is characterized in that, in a toner composition comprising at least binder resin, colorant and charge control agent, the generated concentration of benzene which is generated by heating for 90 seconds at 330° C. is no more than 60 $\mu$g/g.

EXPLANATION OF THE NUMERICAL CODES

1: photosensitive drum

2: charger

Figure 1:
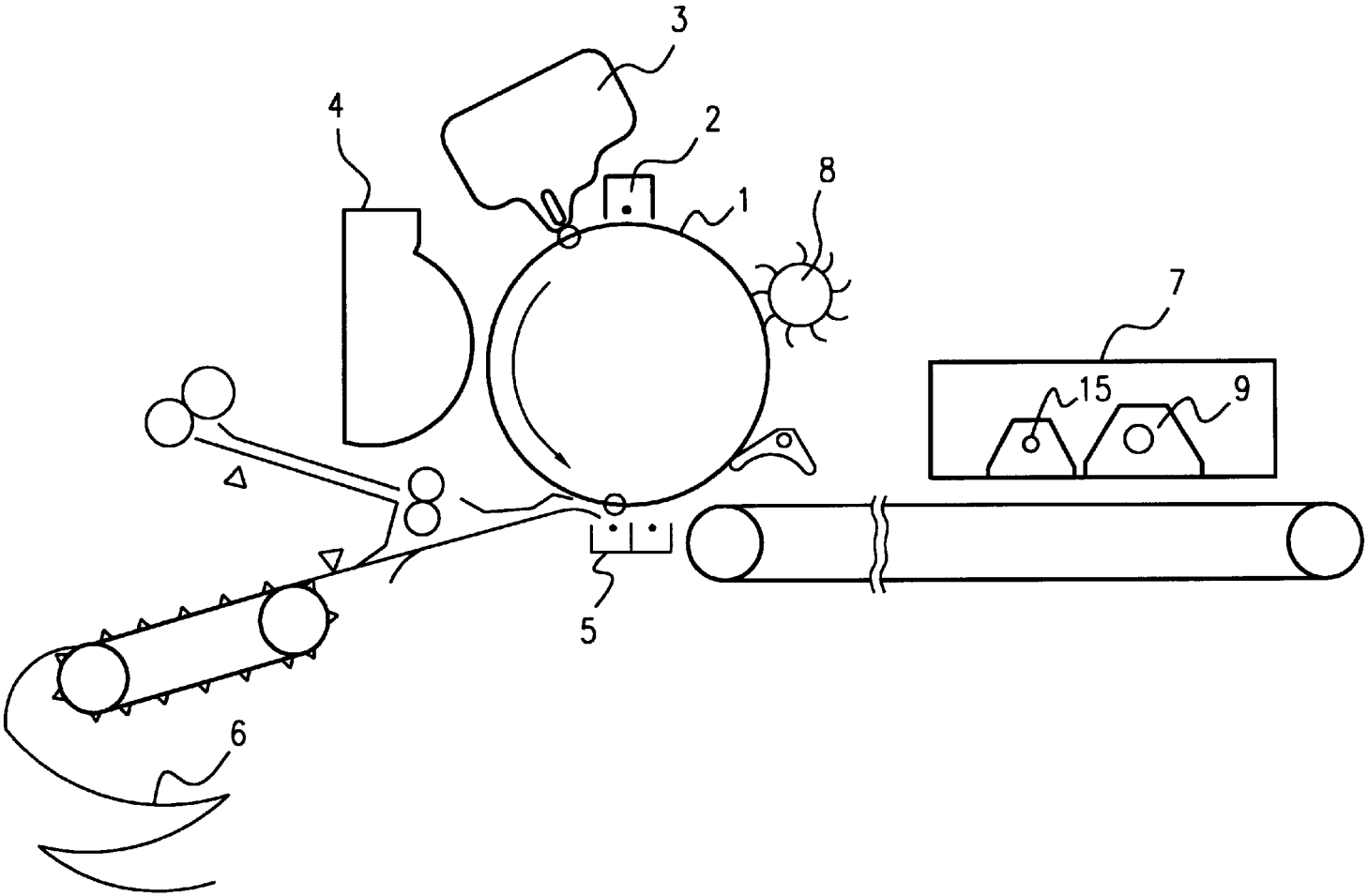
FIG. 1: A schematic longitudinal sectional view showing a print forming device of the present invention

3: imaging device
4: developer device
5: transfer charger
6: recording medium
7: fixer
8: cleaning brush
9: xenon lamp (flash light source)
10: toner
11: reflector
12: glass plate
13: housing
15: halogen lamp
14: attenuator
16: exhaust hole
17: casing

OPTIMUM CONFIGURATION CONFIGURATION FOR PRACTISING THE INVENTION

The toner composition in the present invention, when heat treated for 90 seconds at 330° C. produces a concentration of generated benzene of no more than 60 μg/g and preferably no more than 40 μg/g. If the concentration of generated benzene exceeds 60 μg/g, measures such as augmenting the smoke filter become necessary.

In regard to the decomposition products which determine the necessity for a filter and its life, from the point of view of legal controls it is the generation of benzene as a decomposition product which is the problem. As a method for specifying the amount of such benzene generated, there is the method of running the printer and collecting the exhaust gas generated therefrom and subjecting this to quantitative analysis, but sampling is difficult and there are difficulties such as the influence of factors other than the toner, and so the characteristics preferred as a toner have not been ascertained. The present inventors have continued investigating practical and reproducible conditions and have discovered that the amount of benzene generated by heating at 330° C. for 90 seconds forms the basis for judging the suitability of the toner, and they have found that if a toner is used where the amount generated is no more than 60 μg/g, the life of the filter is markedly extended.

When the flash voltage, which correlates with the flash energy, was varied, it was found that benzene generation is observed at the normally-used voltage of 1850 V, but that the benzene generation is markedly lowered by reduction to 1750 V. It is inferred therefore that the toner is instantaneously exposed to a high temperature at the time of flash fixing, and when the conditions at this particular voltage were then indirectly estimated using an indicator material of known decomposition temperature, they were found to correspond to decomposition conditions comprising a certain time at around 330° C. Thus, when the amount of benzene generated by the toner was evaluated under conditions of 90 seconds, sufficient for the indicator material to decompose, at 330° C., it was found that there was a good relation between the evaluation result and the amount of benzene generated from the actual printer.

Any method of measurement can be adopted providing it can measure the amount of benzene generated over 90 seconds at 330° C.; for example, a few tens of milligrams of the sample is introduced into a glass container of internal capacity 20 ml and, after purging with nitrogen, then sealed and heated for 90 seconds in an electric oven at 330° C. 0.5 ml of the gas phase inside the container is injected into a gas chromatograph and the amount of generated benzene is determined. The gas chromatography measurement conditions employed here are given, but any method can actually be used which enables the benzene to be determined quantitatively with good reproducibility. Thus, measurement is possible using the following conditions.

Gas chromatography conditions:

column: SPB-1 S 0.32 mm×60 mm carrier gas: He column temperature: 50° C.→280° C. (10° C./min)

detector: FID amount injected: 0.5 ml

Various means can be considered for achieving such a level of generation, but the present inventors have painstakingly investigated the causes of the generation of benzene, as a result of which they have shown that this generation of benzene is because the nigrosine type charge control agents normally generally employed decompose when subject to the light energy of flash fixing and benzene is generated. Hence, it is preferred that the following methods be adopted.

(1) Elimination of the benzene-generating material from within the nigrosine type charge control agent As a result of investigating the mechanism of generation of benzene by the nigrosine type charge control agent, it has been found that along with the benzene produced by the decomposition of the main component there is also present benzene which is produced by the impurities contained in the charge control agent. Thus, as examples of methods for removing these impurities, there are the method of eliminating said impurities by a vacuum heating treatment and the method of cleaning with an organic solvent such as alcohol, but in terms of process simplicity the method of carrying out a vacuum heating treatment is preferred.

(2) The use of a charge control agent of a kind which does not generate benzene

As such a material, the use of a quaternary ammonium salt compound or triphenylmethane type charge control agent is preferred.

However, in cases where a quaternary ammonium salt compound is used, it is difficult to confer good charging properties on the toner, and in cases where a triphenyl type charge control agent is used, if the fixing is performed at a high temperature the charge control agent decomposes and the print surrounds are contaminated. Hence, eliminating the benzene generating material from within a nigrosine type charge control agent is more preferred.

Here, in cases where a quaternary ammonium salt compound is used as the charge-control agent, the anion of the quaternary ammonium salt compound is preferably an inorganic anion containing a molybdenum or tungsten atom. As specific examples of the inorganic anions there are molybdate, tungstate, phosphomolybdate, silicomolybdate, phosphotungstate, silicotungstate, phosphotungsto-molybdate, silicotungsto-molybdate, phosphotungsto-molybdate and chromomolybdate.

As actual examples of this kind of quaternary ammonium salt compound, there are TP-302 and 415 produced by the Hodogaya Chemical Co.

The amount of the quaternary ammonium salt compound added is preferably from 0.1 to 5 parts by weight per 100 parts by weight of the toner composition. With less than 0.1 part by weight, it is not possible to confer sufficient charging properties on the toner, while more than 5 parts by weight leads to increased costs in that the charge control agent is more expensive than the other toner components.

In the case where a triphenylmethane type charge control agent is used as the charge control agent, examples of said triphenylmethane type charge control agent include C.I. Solvent Blue 66 and 124, C.I. Pigment Blue 61, 56, 19 and 18, with the use of C.I. Solvent Blue 124 being preferred. As specific examples of such triphenylmethane type charge control agents there are "Copy Blue" PR and "Brilliant Blue Base" SM produced by Hoechst, and "BASF Alkali Blue" NBD 6156 DLD produced by BASF Japan.

The preferred amount of triphenylmethane type charge control agent added per 100 parts by weight of the toner composition is from 0.1 to 5 parts by weight. With less than 0.1 part by weight it is not possible to confer sufficient charging properties on the toner, while more than 5 parts by weight leads to increased costs in that the charge control agent is more expensive than the other toner components.

Furthermore, in the method of vacuum heat treating the nigrosine type charge control agent, it is desirable that the vacuum heat treatment be carried out at a temperature of at least 100° C. but below 250° C., and at a degree of vacuum of 0.02 MPa or lower, with a vacuum heat treatment at a temperature of at least 100° C. but below 250° C., and at a degree of vacuum of 0.005 MPa or lower being preferred, and vacuum heat treatment at a temperature of at least 130° C. but below 220° C., and at a degree of vacuum of 0.003 MPa or lower further preferred.

The suppression of the benzene generation at the time of flash fixing by such treatment could not have been predicted. This is because if the benzene is generated by thermal decomposition of the charge control agent, for example the nigrosine type compound itself, then it is not conceivable that the source of the benzene generation could be eliminated by a vacuum heat treatment. The invention in this application was firstly conceived due to the realization that the source of the benzene generation was not the charge control agent itself.

If the heating temperature is less than 100° C., it is not possible to suppress the generation of decomposition products and there is no effect in extending the life of the filter, while if it exceeds 250° C. then decomposition of the charge control agent itself commences, and its charging function as a charge control agent is lost. If the degree of vacuum is greater than 0.02 MPa, a long vacuum heat treatment time becomes necessary to provide an effect and this is impractical. Furthermore, in regard to the nigrosine type charge control agent content, this is preferably from 0.1 to 5 wt % in terms of the toner composition as a whole, and more preferably from 0.5 to 2 wt %.

Now, in the method of subjecting the nigrosine type charge control agent to a cleaning treatment with organic solvent, examples of the organic solvent are alcohols such as methanol, ethanol, propanol, isopropanol and butanol, ketones such as acetone, methyl ethyl ketone, methyl isobutyl ketone and hexanone, and aromatics such as toluene and xylene, but a cleaning treatment with an alcohol is preferred.

As an example of an actual method for conducting the cleaning treatment, there is the method of carrying out the cleaning at room temperature with several times the amount of organic solvent in terms of the nigrosine type charge control agent, and then repeating this procedure a number of times.

The toner composition in the present invention comprises, at least, binder resin, colorant and charge control agent, and these components will now be explained.

Known binder resins can be used as the binder resin contained in the toner composition in the present invention, examples of which are polystyrene homopolymer, styrene copolymers such as styrene-isobutylene copolymer, styrene-butadiene copolymer, acrylonitrile-butadiene-styrene copolymer, styrene-acrylic copolymer, styrene-methyl methacrylate copolymer, styrenen butyl methacrylate copolymer and styrene-glycidyl methacrylate copolymer, acrylic homopolymers and copolymers such as polymethyl methacrylate, polyethyl methacrylate, poly n-butyl methacrylate and polyglycidyl methacrylate, polyester resins such as polyethylene terephthalate, fumaric acid/etherified diphenyl based polyester and crosslinked polyesters based on polyhydric alcohols and/or polycarboxylic acids, and epoxy resins. Of these, the polyester resins are ideal for reducing the smell caused by decomposition at the time of the flash fixing.

While not being particularly restricted, a polyester resin obtained from an acid component where at least 80 mol % of the polyester resin acid component is a phthalic acid type dicarboxylic acid and at least 80 mol % of the alcohol component is a bisphenol A alkylene oxide adduct is preferred. Furthermore, taking into consideration the fixing properties, it is preferred that the softening point lies in the range 80 to 130° C., the glass transition point (Tg) lies in the range 55 to 70° C. and the temperature at which the melt viscosity determined by means of a flow tester reaches 10000 centipoise lies in the range 90 to 135° C., and, in regard to the molecular weight distribution of the polyester, the number average molecular weight is suitably from 2500 to 4500 and the weight average molecular weight from 7000 to 130,000.

Known colorants can be used as the colorant contained in the toner composition in the present invention and, for example, as well as furnace black, acetylene black, channel black or other carbon black, there can be used ferromagnetic fine particles such as, for example, magnetite fine powder. Again, it is also possible to use mixtures of ferromagnetic fine particles and carbon black as a black colorant. Of these colorants, the dispersion of the carbon black in the binder resin is important in terms of toner charge stability and, where required, it is possible to jointly employ a dispersing agent. Moreover, the carbon black content is preferably from 1 to 10 parts by weight per 100 parts by weight of the toner composition. With less than 1 part by weight, the masking power of the binder resin is insufficient, and a sufficient print density cannot be obtained. On the other hand, when there is more than 10 parts by weight, while this may be desirable in term of increasing the masking power of the print formed and raising the print density, as a result of the carbon black chain structure formed in the toner particles the toner particles become excessively electroconductive, so the insulating properties are impaired and the toner charging properties reduced, as a result of which the print density is lowered and, furthermore, there is an increase in background contamination and toner scatter.

Optionally, there can be added in the toner composition of the present invention, as a fluidity enhancing agent, inorganic fine particles or organic fine particles of mean particle size 0.005–1.0 μm. As the inorganic particles, there can be used fine particles of, for example, silica, titanium oxide or aluminium oxide. In particular, fine silica particles which have been subjected to a hydrophobicity-conferral treatment are preferred in that high fluidity is reliably obtained. Moreover, as the organic particles, there can be used, for example, polyvinylidene fluoride particles or fine resin particles of polymethyl methacrylate, fluoro-polymers or silicone resins.

The mean particle size of the toner composition of the present invention is preferably from 4 to 20 μm, with from 6 to 12 μm being further preferred. In the case where the mean particle size of the toner is less than 4 μm, production by conventional kneading and pulverizing methods is difficult and the product yield is markedly reduced, while if it is more than 20 μm problems arise such as a deterioration in the fine line reproducibility.

The toner composition used in the present invention can be produced by conventionally-known methods. That is to say, it is possible to obtain the desired toner composition by, for example, premixing the binder resin, colorant, charge control agent and, optionally, dispersion adjuvant, etc., by means of a super mixer, followed by uniform dispersion, fusion and kneading in a twin-screw extruder, then carrying out fine pulverising with a jet mill, after which particle size classification is carried out by wind force classification.

The toner composition of the present invention can be used as a two-component developer by mixing with a carrier. Furthermore, in the case where the toner composition contains a magnetic substance, it can also be used, as it is, as a one-component developer for the development of an electrostatic latent image. The carrier comprises, for example, a magnetic material such as a metal like iron, manganese, cobalt, nickel or chromium, a metal oxide like chromium dioxide, hematite or magnetite, or a ferrite. The ferrite is a material typified by the general formula $MFe_2O_4$ (where M=Mn, Co, Mg, Zn or Cu) Now, in the case where the carrier is composed of a metal material, it is preferred that an oxide coating be formed so as to prevent oxidation of the carrier surface. Furthermore, as well as a magnetite or ferrite carrier where fine particles of magnetite or fine particles of ferrite are granulated, it is also possible to use a so-called binder type carrier where fine magnetite particles or fine ferrite particles and a charge control agent are dispersed in a resin. Again, with the objective of improving the charging characteristics at the carrier surface, coating may be performed with a resin identical to or different from the resin contained in the toner composition.

In regard to the particle size of the carrier, there is generally used a carrier of particle size from 20 to 200 μm, but using a carrier of small particle size from 20 to 60 μm is preferred for obtaining a good print density. Measurement of the carrier particle size has been carried out using a laser light scattering analyser for particle size measurement, model SALD-2000J (manufactured by the Shimadzu Corporation).

A two-component developer is produced by mixing an aforesaid carrier with the toner composition. The blending ratio of the toner composition is normally about 5–30 wt % in terms of the total amount of toner composition plus carrier, but this will depend greatly on differences in the carrier type, the charging characteristics of the toner used and the development system. The specific surface area of the carrier increases the smaller the particle size of the carrier so, in general, the toner blending ratio can be increased. In cases where the toner concentration in the developer is too low, the print density is lowered, or there tends to occur sticking of the carrier to the photosensitive body, that is to say so-called 'carrier over'. On the other hand, in cases where the toner concentration is too high, there is marked print background contamination and contamination of the printer interior and exterior due to toner scatter, and so the appropriate toner blending ratio is decided by carrying out an actual printing evaluation with the printer.

The toner composition of the present invention for electrostatic latent image development is used in a print fixing device which fixes the toner image on a recording medium by means of a flash of light. More preferably, it is used in a print fixing device which is characterized in that there is provided between the flash light source and the recording medium an attenuator which locally restricts the radiant energy emitted from the flash light source which is to be applied to the toner image on the recording medium. Again, it is preferred that there be used a print fixing device which is characterized in that there is provided on a part of the outer wall of the flash light source an attenuator which locally restricts the radiant energy.

Moreover, in the print fixing device of the present invention, the aforesaid attenuator is provided with the property of reflecting, scattering or diffracting radiant energy from the aforesaid light source.

Again, in the print fixing device of the present invention, the aforesaid attenuator is preferably one which strongly restricts the radiant energy in at least a part of the region on the recording material where high radiant energy would have been applied, and which weakly restricts the radiant energy in at least a part of the region on the recording medium where low radiant energy would have been applied, in the case where the radiant energy was not thus restricted by said attenuator.

Furthermore, in the print fixing device of the present invention, it is preferred that there be provided a preheating means which preheats the aforesaid recording medium before the radiant energy is applied to the toner image by means of the aforesaid light source.

In the present invention, "restricts the radiant energy" means that, by placing an attenuator between the flash light source radiant energy generating region and the recording material feed route, radiant energy is absorbed, reflected, scattered or refracted, and there is a diminution in part of the radiant energy applied to a specified region (in most cases the region where the energy density is highest) on the recording material or toner image thereof, when compared to the case when no attenuator is present. Now, preferably it is arranged that the radiant energy intercepted by the attenuator is applied to other regions on the recording material by reflection, diffusion or diffraction. In this way, it is possible to make the distribution of radiant energy applied to the recording medium, or toner thereon, more uniform in the feed direction. Furthermore, the attenuator may also be provided at or near the surface of the light source.

In the present invention, the recording medium can be any material on which the toner image may be fixed. In most cases a sheet-shaped material such as paper, plastic film, fabric or metal plate is preferably used. With paper or a plastic film, distortion or degeneration such as scorching may occur as a result of excessive heating, so these are suitable materials for application in the present invention where the maximum energy density can be lowered.

A typical method of print forming using the toner composition of the present invention and the features of the electrophotographic printer (print forming device) will be explained using FIG. 1. In the electro-photographic printer, a toner image is formed on the photosensitive drum 1. Firstly, using charger 2, the photosensitive drum 1 is uniformly charged. Next, using imaging device 3 equipped with an LED array or laser beam, spatially selective imaging is performed in accordance with the desired print to be formed. The latent image produced on the photosensitive drum 1 is developed using developing device 4 by means of a developer, and a toner image is formed on the photosensitive drum 1. By means of transfer charger 5, this developed toner image is transferred onto recording medium 6. While feeding the recording medium 6 at a constant speed, fusing and fixing are carried out by means of fixer 7.

Toner image which has not been transferred to the recording medium is cleaned away by means of cleaning brush 8 to which a minus bias has been applied in terms of the toner, and the drum is returned to its initial state.

Figure 2:
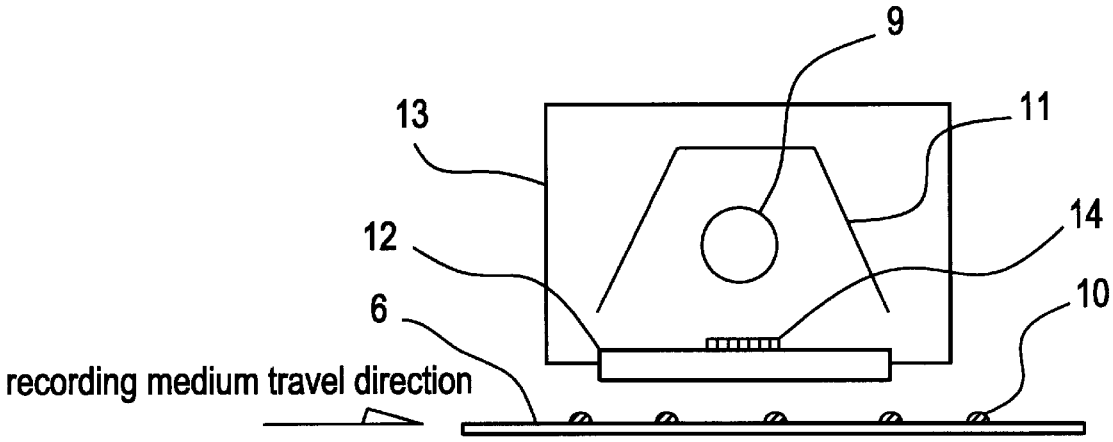
FIG. 2: A schematic sectional view showing a fixing device of the present invention
Figure 3:
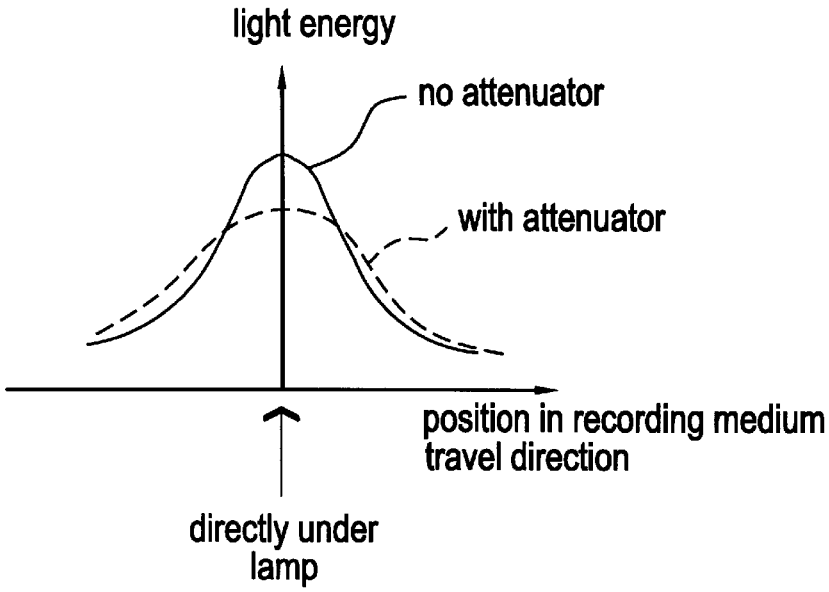
FIG. 3: A graph showing the radiant energy distribution on the recording material based on the print fixing device shown in FIG. 2

The attenuator is now explained using FIGS. 2 and 3. FIG. 2 describes the fixer 7 in detail. In the fixer, by means of flash light source 9, the toner image 10 lying on the recording medium 6 is subjected to irradiation by radiant energy which causes fixing by a light-to-heat conversion action. As the flash light source there can be used, for example, a xenon lamp, neon lamp, argon lamp or krypton lamp. In order that the radiant energy from the flash light source is used effectively, a reflector 11 is arranged to the rear of the flash light source. Additionally, there is a glass plate 12 and housing 13 for constructing the fixing device. The radiant energy from the flash light source 9, together with the component reflected from the rear reflector 11, passes through the glass plate 12 and irradiates the toner image 10 already formed on recording medium 6. The irradiated radiant energy is selectively absorbed by the toner image 10, so that the toner is heated and fuses, and it is fixed to the recording medium 6. As shown in FIG. 3, the radiant energy distribution on the recording medium is normally highest in the region lying directly below the flash light source 9, and in the case of the present invention when there are no restrictions on the radiant energy, it is known that shape close to a Gaussian distribution is produced.

Hence, an attenuator 14 is positioned between the flash light source 9 and the recording medium 6 and, furthermore, this is arranged so as to be positioned on the shortest distance between flash light source 9 and recording medium 6. By so doing, it is possible to position the attenuator 14 on the path of the light beams irradiating the region of highest radiant energy on the recording medium 6, and so the radiant energy irradiated from the flash light source 9 is locally reduced. The effect of this is that it is possible to lower the high radiant energy peak inherently produced directly below the flash light source and, as shown in FIG. 3, it is possible thereby to make the radiant energy distribution more uniform.

Moreover, by having an attenuator 14 which does not absorb light, that is to say one which has the property of diffusing or reflecting, a transfer to the surrounding regions of radiant energy which is otherwise concentrated directly below the flash light source 9 can also be expected. Furthermore, because the light is not absorbed, there is little heating of the attenuator 14 by absorption of the radiant energy and a stable effect can be expected. As examples of materials with which such an effect can be expected, taking the case of reflecting materials, metal meshes or grids and chromium vapour deposited films can be considered. For the mesh or grid, stainless steel is preferred from the point of view of heat resistance and weatherability. As a diffusing material, a heat-resistant optical diffusion plate may be considered. Frosted glass where the glass surface is roughened can be used as this optical diffusion plate. Furthermore, a cylindrical lens may be considered as a refracting material. Moreover, in the case where a chromium vapour deposited film or an optical diffusion plate is employed as attenuator 14, said attenuator 14 can also be integrally formed with glass plate 12.

Additionally, it is possible to obtain a more uniform radiant energy distribution by varying the radiant energy restriction factor in the recording medium 6 feed direction. That is to say, attenuator 14 is provided with the property of being more strongly restrictive the closer it is to the flash light source 9 and the more it lies within the region of high radiant energy. Specifically, in the case of a metal mesh or grid, the mesh density is raised towards the central region, and the mesh density is lowered towards the peripheral regions. In the case of the vapour deposition of chromium, the same effect can be achieved by increasing the amount of vapour-deposited metal towards the centre and reducing it towards the peripheral regions.

FIG. 3 shows the radiant energy distribution on the recording medium 6 in the case where there is or is not an attenuator 14. It is clear that a more uniform radiant energy distribution is obtained in the case where there is an attenuator 14.

A glass plate 12 is preferably interposed between the flash light source 9 and the recording medium 6 in order to prevent paper dust generated from the recording medium, or toner, or gas or the like generated from the toner, from contaminating the flash light source 9 and the reflector 11. Again, providing attenuator 14 on the flash light source 9 side of the glass plate 12 is preferred in that it enables contamination of said attenuator 14 by the toner 10, etc., to be prevented.

Figure 4:
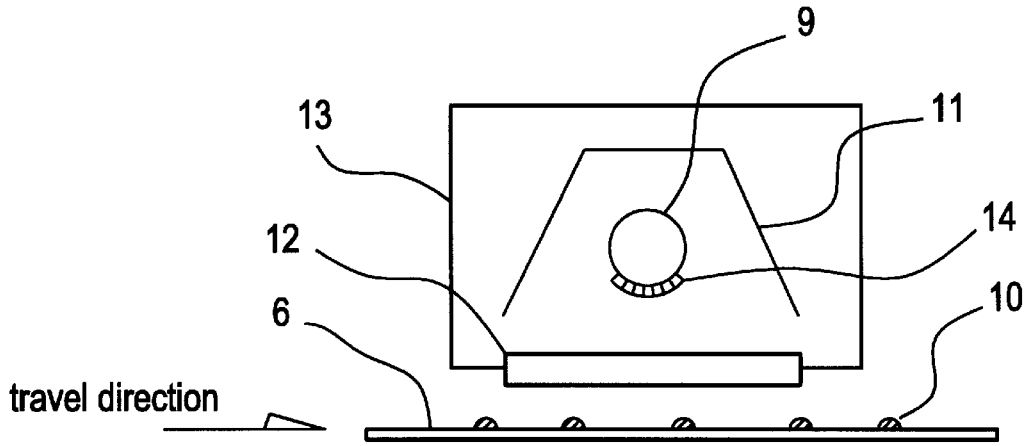
FIG. 4: A schematic sectional view showing an embodiment of the fixing device of the present invention

Moreover, as shown in FIG. 4, the attenuator 14 may also be constructed on the outer wall of the flash light source 9. Since it can be integrally formed with the flash light source 9, there is the advantage that the device can be simplified.

Below, more specific explanation is provided of examples of the present invention but the invention is not to be restricted by these.

EXAMPLES

Reference Example 1 (Details of the fixing device)

Using FIG. 1, explanation will be given of the main features of an electrophotographic printer (print forming device) which includes the fixing device and fixing method employed in the fixing of the toner composition of the present invention used for electrostatic latent image development. In an electrophotographic printer the toner image is formed on a photosensitive drum 1. Firstly, photosensitive drum 1 is uniformly charged using charger 2. Next, using an imaging device 3 equipped with an LED array or laser beam, imaging is carried out spatially selectively corresponding to the print to be formed. The latent image thereby formed on the photosensitive drum 1 is developed by means of toner using developer 4, and a toner image is formed on photosensitive drum 1. The toner image developed in this way is transferred onto recording medium 6 by means of transfer charger 5. While feeding the recording medium 6 at a fixed rate, fusing and fixing are carried out by fixer 7 as described in the embodiment above.

A practical example of the fixing device and fixing method of the present invention will now be explained using FIG. 1.

In this example, the toner image is fixed on the recording medium by means of both a halogen lamp 15, which emits radiant heat energy in which the chief component is far infrared radiation of peak energy wavelength in the region of 2 to 5 $\mu$m, lying forwardly positioned in the interior of the fixer, and flash light source 9. Halogen lamp 15 shines continuously and preheats the recording medium 6 and toner image 10. By means of this preheating, the moisture which may be present in cases such as where the recording medium is paper, is eliminated to a certain extent, and the entire recording medium 6 is preheated. The far infrared radiation is efficiently absorbed not only by the toner image but also by the recording medium 2, and suppresses the subsequent production of a temperature difference between the toner image and the recording medium due to the radiant energy applied by flash light source 9 which is efficiently absorbed by the toner image, thus making firmer fixing possible. In other words, it has a supplementary role such that good fixing performance is obtained even when the radiant energy of the flash light source 9 is comparatively low. Furthermore, towards the rear of the interior of the fixer, there is provided an exhaust hole 16 for the absorption of unpleasant odours or gases generated from the toner at the time of fixing.

A xenon lamp is used as flash light source 9. The exterior dimensions of the xenon lamp in this example are a diameter of about 15 mm and a length of about 425 mm in the light-emitting region, with the rated impressed voltage being 1850 V and the rated energy 343 J. The generated energy of the flash light source 9 is preferably at least 200 J. This xenon lamp flashed at a 6.6 Hz period, along with the feeding of the recording medium 6 (at about 225 mm/sec). In other words, the xenon lamp flashed at intervals of about 34 mm on the recording medium 6.

Figure 5:
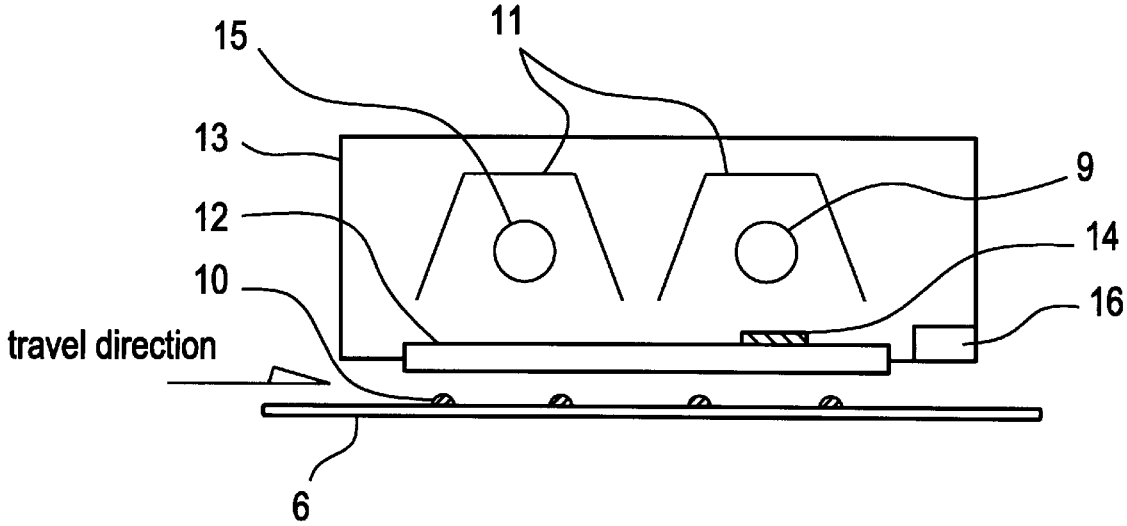
FIG. 5: A schematic longitudinal sectional view showing an embodiment of the print fixing device of the present invention
Figure 6:
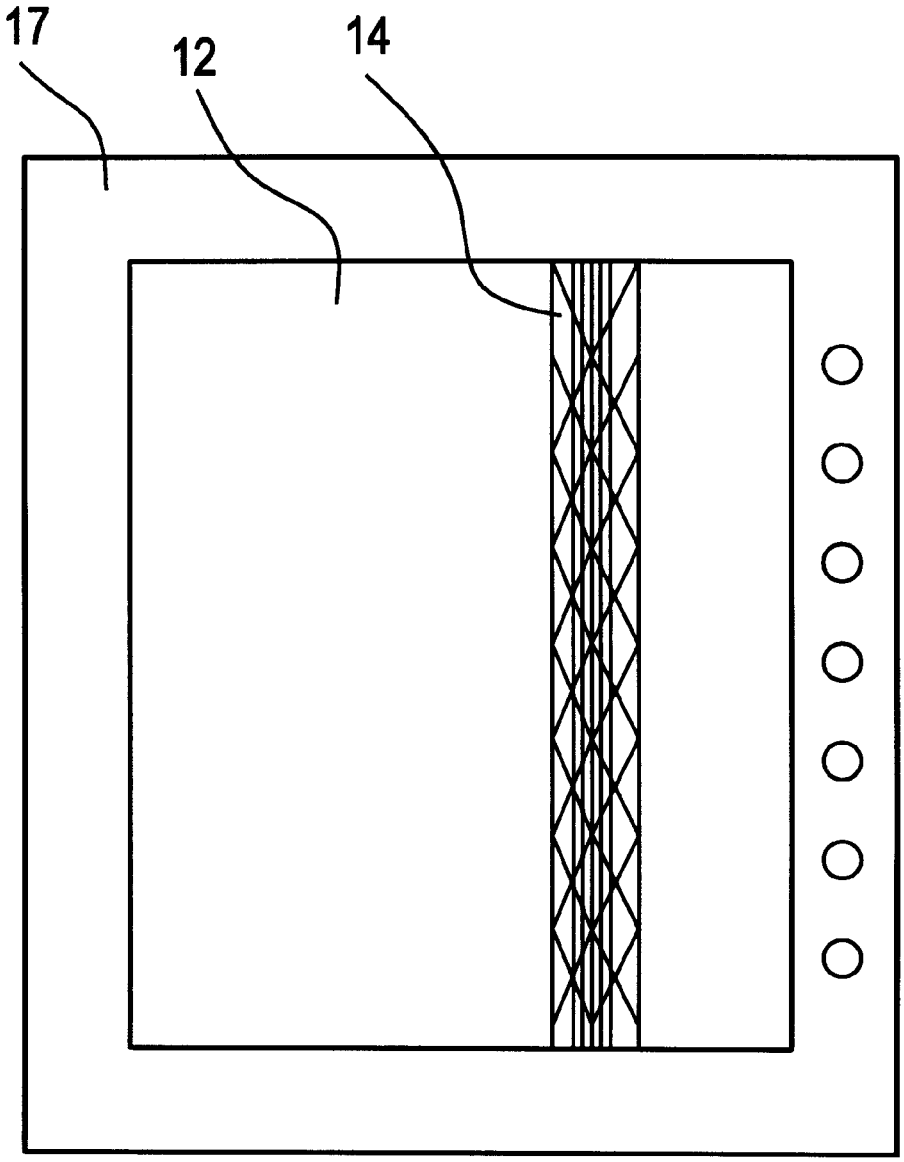
FIG. 6: A view of a practical example of the invention seen from the recording medium side

An attenuator 14 was provided between the flash light source 9 and the recording medium 6 feeding route. A grid shape attenuator 14 was used, produced by the etching of 0.1 mm thickness stainless steel sheet (width 14 mm, length 441 mm). FIG. 5 shows the attenuator viewed from the recording medium side. This attenuator 14 comprised eleven 0.1 mm width wires running in parallel with the lengthwise direction of the flash light source 9 (the direction essentially at right angles to the recording material 2 feed direction) and several slanting wires mutually connect thereto. The eleven wires parallel to the lengthwise direction of the flash light source 9 are arranged so that their arrangement density is higher in the region which corresponds to directly beneath the flash light source 9 and then the density falls moving outwards. The several slanting wires act both to mutually connect the parallel wires and also to increase the level of restriction.

The attenuator 14 with this stainless steel network construction is placed on glass plate 12 directly under the flash light source 9, and its two ends are secured by interposing between glass plate 12 and casing 17.

Tests were carried out using the example of a print forming device having this construction and employing the following toners.

Reference Example 2 (Production of a Standard Carrier)

polyester resin ("Tuftone" TTR-2, manufactured by the Kao Corporation) . . . 24 wt % magnetic material (EPT-1000, manufactured by Toda Kogyosha) . . . 74 wt % charge control agent ("Bontron" S-34, manufactured by Orient Kagakusha) . . . 1 wt % wax (Luvax-1151, manufactured by the Nippon Seiro Co.) 1 wt %

After thoroughly mixing the aforesaid components, melting and kneading were carried out with a twin-screw extruder (PCM-30, manufactured by the Ikegai Corporation) . After cooling the kneaded material, it was subjected to coarse pulverizing with a coarse pulverizer (UG-210KGS, manufactured by Horai Tekkosho) to a 2 mmΦ pass size, then this was subjected to medium pulverizing with a medium pulverizer ("Finemill" FM-300N, manufactured by the Nippon Pneumatic Mfg Co.), following which using a fine pulverizer ("Separator" DS-5UR, manufactured by the Nippon Pneumatic Mfg Co.) classification was carried out and a resin carrier obtained of weight average particle size 50 $\mu$m.

Reference Example 3

•Bontron"-N 01, manufactured by Orient Kagakusha, was treated for six hours by heating under a 0.001 MPa vacuum at 190° C., to produce charge control agent A.

Reference Example 4

•Bontron" N-01, manufactured by Orient Kagakusha, was treated for twelve hours by heating under a 0.002 MPa vacuum at 160° C., to produce charge control agent B.

Reference Example 5

•Bontron" N-01, manufactured by Orient Kagakusha, was treated for six hours by heating under a 0.001 MPa vacuum at 90° C., to produce charge control agent C.

Reference Example 6

•Bontron" N-01, manufactured by Orient Kagakusha, was treated for six hours by heating under a 0.002 MPa vacuum at 160° C., to produce charge control agent D.

Reference Example 7

10 g of "Bontron" N-01, manufactured by Orient Kagakusha, was washed three times with 100 g of methanol (reagent grade, produced by Nacalai Tesque), while changing the methanol, to produce charge control agent E.

Example 1

Toner was produced using the following components.

[Toner Composition]

polyester resin ("Tuftone" TTR-2, manufactured by the Kao Corporation . . . 60 wt % polyester resin ("Tuftone" TTR-5, manufactured by the Kao Corporation . . . 1.6 wt % magnetic material (EPT-1000, manufactured by Toda Kogyosha) . . . 20 wt % carbon black (manufactured by the Cabot Corp., "Regal" 330R) . . . 2 wt % charge control agent A from Reference Example 3 . . . 2 wt %

After thoroughly mixing the aforesaid components, melting and kneading were carried out with a twin-screw extruder (PCM-30, manufactured by the Ikegai Corporation), after which fine pulverizing was carried out in a jet mill pulverizer (PJM-100, manufactured by Nippon Pneumatic Mfg Co.), then classification carried out with a wind force classifier (A-12, manufactured by Alpine-sha) and toner of weight average particle size 8$\mu$ obtained. Furthermore, in order to enhance the fluidity of the toner, there was added 1.2 wt %, in terms of the toner, of hydrophobic fine silica particles (manufactured by Hoechst Japan, HVK-2150), then mixing performed with a Super Mixer (SMV-20, manufactured by Kawada-sha) to prepare the toner, and a positively charging toner obtained.

The amount of benzene generated when this toner was heat-treated for 90 seconds at 330° C. was 9 $\mu$g/g.

Next, developer was prepared by blending 90 wt % of the resin carrier produced in Reference Example 2 with 10 wt % of this toner, and printing carried out with the LED printer described in Reference Example 1 and evaluation of the print quality performed. In this printer, there was used a filter comprising 300 g of active carbon. A good print was obtained initially and after 900,000 prints. Furthermore, the amount of benzene in the exhaust gas following passage through the filter was measured initially and after 900,000 prints, but there was no significant difference in terms of the surrounding atmospheric level of 1 ppb and it was less than the level of fluctuation in the atmosphere (0.3 ppb).

The measurement of the amount of benzene was performed by collecting 1 litre of gas from the filter passage region using a solid capture method (Carbotrap 400), then setting the trap tube in a thermal desorption unit (TDU) and performing analysis by a thermal desorption~GC-FID, GC/MS method.

Example 2

Toner was produced in the same way as in Example 1 except that, instead of charge control agent A in the toner composition, there was used charge control agent B. The amount of benzene generated when this toner was heat-treated for 90 seconds at 330° C. was 14 μg/g. Developer was prepared in the same way employing this toner. Using this developer, printing was carried out in the same way as in Example 1 with the LED printer described in Reference Example 1 and evaluation of the print quality carried out. A good print was obtained initially and after 900,000 prints. Furthermore, the amount of benzene in the exhaust gas following passage through the filter was measured initially and after 900,000 prints, but there was no significant difference in terms of the surrounding atmospheric level of 1 ppb and it was below the level of fluctuation in the atmosphere (0.3 ppb).

Comparative Example 1

Toner was prepared in the same way as in Example 1 except that, instead of charge control agent A from Reference Example 3, there was used "Bontron" N-01 which is an untreated nigrosine type charge control agent. The amount of benzene generated when this toner was heat-treated for 90 seconds at 330° C. was 100 μg/g. Developer was prepared in the same way as in Example 1 employing this toner. Using this developer, printing was carried out in the same way as in Example 1 with the LED printer described in Reference Example 1 and evaluation of the print quality carried out. As a result of the printing, good prints were obtained. However, when the amount of benzene in the exhaust gas was measured it was, at 9 ppb, higher than the atmospheric level (1 ppb), and it was clear that the use of a filter was necessary. Hence, printing was carried out using 300 g of active carbon as a filter, but while there was initially no significant difference in terms of the surrounding atmospheric level of 1 ppb, after 600,000 prints the amount of benzene in the exhaust gas following passage through the filter was, at 2 ppb, greater in terms of the level of fluctuation in the atmosphere, and so replacement of the filter was necessary.

Comparative Example 2

Toner was prepared in the same way as in Example 1 except that, instead of the charge control agent A from Reference Example 3, there was used "Bontron" N-13 which is an untreated nigrosine type charge control agent. The amount of benzene generated when this toner was heat-treated for 90 seconds at 330° C. was 150 μg/g. Developer was prepared in the same way as in Example 1 employing this toner. Using this developer, printing was carried out in the same way as in Example 1 with the LED printer described in Reference Example 1 and evaluation of the print quality carried out. As a result of the printing, good prints were obtained. However, when the amount of benzene in the exhaust gas was measured, it was, at 10.5 ppb, higher than the atmospheric level (1 ppb), and it was clear that the use of a filter was necessary. Hence, printing was carried out using 300 g of active carbon as a filter, but while there was initially no significant difference in terms of the surrounding atmospheric level of 1 ppb, after 600,000 prints the amount of benzene in the exhaust gas following passage through the filter was, at 2 ppb, greater in terms of the level of fluctuation in the atmosphere, and so replacement of the filter was necessary.

Comparative Example 3

Toner was prepared in the same way as in Example 1, except that instead of charge control agent A in the toner composition there was used charge control agent C. The amount of benzene generated when this toner was heat-treated for 90 seconds at 330° C. was 74 μg/g. Developer was prepared in the same way employing this toner. Using this developer, printing was carried out in the same way as in Example 1 with the LED printer described in Reference Example 1 and evaluation of the print quality carried out. As a result of the printing, a good print was obtained initially and after 700,000 prints. However, when the amount of benzene in the exhaust gas after passage through the filter was measured following 700,000 prints, the amount was, at 2 ppb, significant in terms of the level of fluctuation in the atmosphere (0.3 ppb), and so replacement of the filter was necessary.

Example 3

Toner was prepared in the same way as in Example 1 except that, instead on charge control agent A in the toner composition, there was used charge control agent D. The amount of benzene generated when this toner was heat-treated for 90 seconds at 330° C. was 32 μg/g. Developer was prepared in the same way employing this toner. Using this developer, printing was carried out in the same way as in Example 1 with the LED printer described in Reference Example 1 and evaluation of the print quality carried out. A good print was obtained initially and after 900,000 prints. Furthermore, the amount of benzene in the exhaust gas following passage through the filter was measured initially and after 900,000 prints, but there was no significant difference in terms of the surrounding atmospheric level of 1 ppb and it was below the level of fluctuation in the atmosphere (0.3 ppb).

Example 4

Toner was prepared in the same way as in Example 1 except that, instead on charge control agent A in the toner composition, there was used charge control agent E. The amount of benzene generated when this toner was heat-treated for 90 seconds at 330° C. was 36 μg/g. Developer was prepared in the same way employing this toner. Using this developer, printing was carried out in the same way as in Example 1 with the LED printer described in Reference Example 1 and evaluation of the print quality carried out. A good print was obtained initially and after 900,000 prints. Furthermore, the amount of benzene in the exhaust gas following passage through the filter was measured initially and after 900,000 prints, but there was no significant difference in terms of the surrounding atmospheric level of 1 ppb and it was below the level of fluctuation in the atmosphere (0.3 ppb).

Example 5

Toner was produced using the following components.

[Toner composition]

polyester resin ("Tuftone" TTR-2, manufactured by the Kao Corporation . . . 60 wt % polyester resin ("Tuftone" TTR-5, manufactured by the Kao Corporation . . . 16 wt % magnetic material (EPT-1000, manufactured by Toda Kogyosha) . . . 20 wt % carbon black (manufactured by the Cabot Corp., "Regal" 330R) . . . 2 wt % triphenylmethane type charge control agent ("Copy Blue" PR, manufacture by Hoechst) . . . 2 wt %

After thoroughly mixing the aforesaid components, melting and kneading were carried out with a twin-screw extruder (PCM-30, manufactured by the Ikegai Corporation), after which fine pulverizing was carried out with a jet mill pulverizer (PJM-100, manufactured by Nippon Pneumatic Kogyosha), then classification carried out with a wind force classifier (A-12, manufactured by Alpine-sha) and toner of weight average particle size 8$\mu$ obtained. Furthermore, in order to enhance the fluidity of the toner, there was added 1.2 wt %, in terms of the toner, of hydrophobic fine silica particles (manufactured by Hoechst Japan, HVK-2150), then mixing performed with a super mixer (SMV-20, manufactured by Kawada-sha) to prepare the toner, and a positively chargeable toner obtained.

The amount of benzene generated when this toner was heat-treated for 90 seconds at 330° C. was 2 $\mu$g/g.

Next, developer was prepared by blending 90 wt % of the resin carrier produced in Reference Example 2 with 10 wt % of this toner, and printing carried out with the LED printer described in Reference Example 1 and evaluation of the print quality performed. The printing was carried out with no filter employed in this printer. As a result of the printing, good prints were obtained. Furthermore, the amount of benzene in the exhaust gas was measured but there was no significant difference in terms of the surrounding atmospheric level of 1 ppb and it was below the level of fluctuation in the atmosphere (0.3 ppb).

The measurement of the amount of benzene was conducted by collecting 1 litre of gas from the filter passage region using a solid trap method (Carbotrap 400), then setting the trap tube in a thermal desorption unit (TDU) and performing analysis by a thermal desorption~GC-FID, GC/MS method.

Example 6

Toner was prepared in the same way as in Example 5 except that instead of the triphenylmethane type charge control agent "Copy Blue", there was used "Brilliant Blue Base" SM (manufactured by Hoechst). The amount of benzene generated when this toner was heat-treated for 90 seconds at 330° C. was 4 $\mu$g/g. Developer was prepared in the same way as in Example 5 employing this toner. Using this developer, printing was carried out in the same way as in Example 5 with the LED printer described in Reference Example 1 and evaluation of the print quality carried out. As a result of the printing, good prints were obtained. Furthermore, the amount of benzene in the exhaust gas was measured, but there was no significant difference in terms of the surrounding atmospheric level of 1 ppb and it was below the level of fluctuation in the atmosphere (0.3 ppb).

Example 7

Toner was produced using the following components.

[Toner composition]

polyester resin ("Tuftone" TTR-2, manufactured by the Kao Corporation . . . 60 wt % polyester resin ("Tuftone" TTR-5, manufactured by the Kao Corporation . . . 16 wt % magnetic material (EPT-1000, manufactured by Toda Kogyosha) . . . 20 wt % carbon black (manufactured by the Cabot Corp., "Regal" 330R) . . . 2 wt % quaternary ammonium salt compound charge control agent (TP-302, produced by Hodogaya Chemical Co.) . . . 2 wt %

After thoroughly mixing the aforesaid components, melting and kneading were carried out with a twin-screw extruder (PCM-30, manufactured by the Ikegai Corporation), after which fine pulverizing was carried out with a jet mill pulverizer (PJM-100, manufactured by Nippon Pneumatic Kogyosha), then classification carried out with a wind force classifier (A-12, manufactured by Alpine-sha) and toner of weight average particle size 8$\mu$ obtained. Furthermore, in order to enhance the fluidity of the toner, there was added 1.2 wt %, in terms of the toner, of hydrophobic fine silica particles (manufactured by Hoechst Japan, HVK-2150), then mixing performed with a super mixer (SMV-2, manufactured by Kawada-sha) to prepare the toner, and a positively chargeable toner obtained. The amount of benzene generated when this toner was heated treated for 90 seconds at 330° C. was 4 $\mu$g/g.

Next, developer was prepared by blending 90 wt % of the resin carrier produced in Reference Example 2 with 10 wt % of this toner, and printing carried out with the LED printer described in Reference Example 1 and evaluation of the print quality performed. The printing was carried out with no filter employed in this printer. As a result of the printing, good prints were obtained. Furthermore, the amount of benzene in the exhaust gas was measured, but there was no significant difference in terms of the surrounding atmospheric level of 1 ppb and it was below the level of fluctuation in the atmosphere (0.3 ppb).

The measurement of the amount of benzene was performed by collecting 1 litre of exhaust gas using a solid trap method (Carbotrap 400), then setting the trap tube in a thermal desorption unit (TDU) and performing analysis by a thermal desorption~GC-FID, GC/MS method.

Example 8

Toner was prepared in the same way as in Example 7 except that, instead of the quaternary ammonium salt compound charge control agent "TP-302", there was used TP-415 (manufactured by Hodogaya Chemical Co.). The amount of benzene generated when this toner was heat-treated for 90 seconds at 330° C. was 2 $\mu$g/g. Developer was prepared in the same way employing this toner. Using this developer, printing was carried out in the same way as in Example 7 with the LED printer described in Reference Example 1 and evaluation of the print quality carried out. As a result of the printing, good prints were obtained. Furthermore, the amount of benzene in the exhaust gas was measured, but there was no significant difference in terms of the surrounding atmospheric level of 1 ppb and it was below the level of fluctuation in the atmosphere (0.3 ppb).

Applicability in Terms of Industrial Nourishment

By using the toner of the present invention, as explained above, it is either possible to extend the period before the filter is replaced or no filter need be employed, so it is possible to lower the printer running costs.

What is claimed is:

1. A toner composition for electrostatic latent image development used in flash fixing, comprising:

a binder resin, a colorant and a charge control agent, wherein a concentration of benzene generated by heating said toner composition for 90 seconds at 330° C. is no more than 60 $\mu$g/g.

2. The toner composition for electrostatic latent image development used in flash fixing according to claim 1, wherein the concentration of the benzene generated is no more than 40 $\mu$g/g.

3. The toner for electrostatic latent image development used in flash fixing according to claim 1, wherein the binder resin is a polyester resin.

4. The toner for electrostatic latent image development used in flash fixing according to claim 1, wherein the toner is positively chargeable.

5. The toner for electrostatic latent image development used in flash fixing according to claim 1, wherein the charge control agent is a nigrosine type compound.

6. The toner for electrostatic latent image development used in flash fixing according to claim 1, wherein the charge control agent is a quaternary ammonium salt compound.

7. The toner for electrostatic latent image development used in flash fixing according to claim 1, wherein the charge control agent is a triphenylmethane type compound.

8. A toner composition fixing method, comprising:

selecting the toner according to claim 1, wherein the charge control agent is selected from the group consisting of quaternary ammonium salt compounds, triphenylmethane type compounds and nigrosine type compounds which have been vacuum heat-treated at a temperature of at least 100° C. but no more than 250° C. under a degree of vacuum of 0.02 MPa or lower; and using the toner in flash fixing.

* * * * *